US005236262A

United States Patent [19]

Espey

[11] Patent Number: 5,236,262

[45] Date of Patent: Aug. 17, 1993

[54] AGITATOR FOR A SPRAY CAN

[75] Inventor: Carl R. Espey, Fairview Park, Ohio

[73] Assignee: Creco Corporation, Seville, Ohio

[21] Appl. No.: 917,496

[22] Filed: Jul. 21, 1992

[51] Int. Cl.[5] ..... B01F 15/00

[52] U.S. Cl. ..... 366/130; 222/402.1; 239/142; 366/342

[58] Field of Search ..... 366/130, 342, 349, 605; 206/220; 222/226, 230, 394, 402.1; 239/142, 144

[56] References Cited

U.S. PATENT DOCUMENTS 1,207,703 12/1916 Basehore et al. ..... 366/130
2,104,325 1/1938 Juffa ..... 366/130 X
2,580,132 12/1951 Seymour ..... 366/130
3,087,707 2/1962 Moonan ..... 366/130
3,290,017 12/1966 Davies et al. ..... 366/130
3,993,290 11/1976 Kovich ..... 366/130
4,095,286 6/1978 Ellis ..... 366/343 X
4,542,823 9/1985 Frick ..... 206/220
4,607,959 8/1986 Miyazaki et al. ..... 366/343
4,641,974 2/1987 Church ..... 366/130 X

*Primary Examiner*—Kevin P. Shaver
*Attorney, Agent, or Firm*—Pearne, Gordon, McCoy & Granger

[57] ABSTRACT

A dense body having a projecting radial flange about its middle is used to agitate the contents in a spray can. When the can is shaken, the agitator moves inside the can to mix pigment or other solid particles with a liquid vehicle in the can. The flange around the body reaches into a corner formed by the side and bottom of the can to provide more effective mixing of the contents. The generally rounded shape of the agitator prevents sticking.

20 Claims, 1 Drawing Sheet

AGITATOR FOR A SPRAY CAN

BACKGROUND OF THE INVENTION

1. Field of the Invention

This invention relates generally to the field of aerosol sprays and specifically to an agitator for a spray paint can.

2. Description of Related Art

A spray can typically contains a mixture of solid particles, such as a pigment, suspended in a liquid vehicle which may include resins, oils and solvents to be sprayed from the can toward some object. Commonly this mixture is paint used to cover and color an object. Also contained in the can is a propellant which is usually a liquified gas, such as butane, propane, or isobutane, contained under pressure in the can. When a valve on the can is opened, the propellant forces the paint from the can and the paint is directed toward the object being sprayed.

If the can remains relatively motionless for any length of time, the pigment tends to settle to the bottom of the can. To assure that the pigment is efficiently removed from the can and sprayed on the object, it is necessary to mix the pigment with the vehicle by some means of agitation.

To achieve mixing, it is possible to merely shake the can, however, when the pigment is dense or cohesive, mixing will generally be inadequate. It has long been known to use a spherical ball as an agitator inside the can to move through and mix the contents when the can is shaken. Such agitator balls remain in use today. However, it has been found that a substantial portion of the pigment is trapped in the corner formed by the side and bottom of the can. The standard spherical agitator, because of its shape, cannot reach into the corner to mix the contents. Moreover, the corners in such cans are made more difficult to access because the pressurized contents of the can require a domed bottom which results in an acute angle at the corner. A smaller ball used as an agitator will tend to stick in the pigment at the corners because of its smaller mass, and therefore, is ineffective.

U.S. Pat. No. 3,087,707 to Moonan shows an agitation means which includes a standard spherical ball and, in addition, several smaller spherical balls. The smaller balls mix the pigment from the corners. The large ball serves the normal agitation function and is also able to dislodge smaller balls which become stuck. This requires a multiplicity of members carefully sized according to the dimensions of the can, so that the small balls can move into the corner and the large ball can dislodge the small balls without itself becoming stuck.

Another type of agitator is a device shown in U.S. Pat. No. 17 2,580,132 to Seymour which resembles a pair of tombstones joined at their bases at an obtuse angle. The Seymour agitator, however, has flat sides with sharp corners which would tend to become stuck in a thick solution.

Uniform spherical balls have remained in use as agitators while the search for a simple and effective agitator has continued.

SUMMARY OF THE INVENTION

The present invention provides an improved agitator for mixing solid particles with a liquid vehicle in a container when the container is shaken. The agitator is a body having a density greater than the solid particles and having a rounded main portion substantially smaller than the volume of the container with at least one projection extending from the main portion.

The precise shape of the agitator may vary, however, the main portion is generally rounded. Flat surfaces have a tendency to stick in the pigment which settles to the bottom, thus, flat surfaces are small or nonexistent on the agitator. Similarly, the shape of the projection is not critical except that is of such a shape that it can reach into the corner at the bottom of the container to agitate the pigment which has settled and mix it with the vehicle and the propellant. Sharp edges are avoided. The preferred projection is symmetrical about the center of the agitator so that its orientation in the can is less critical.

The agitator is considerably more dense than the pigment and has sufficient mass so that when the container is shaken or otherwise agitated, the agitator moves through the pigment which has settled to mix the pigment with the vehicle. Even if the agitator becomes stuck in the pigment during storage, it is dense and massive enough that it will become dislodged after a few shakes of the container.

A container for a liquid which uses this type of agitator is also disclosed. The container holds the solid particles, vehicle and propellant under pressure and has a valved nozzle to release the contents. The agitator inside the container is as described above.

The present invention provides improved mixing and more efficiently uses pigment which would otherwise be discarded because it would not be mixed with the vehicle which carries the pigment out of the can onto the object being sprayed. Thus, a great savings can be achieved.

DESCRIPTION OF THE PREFERRED EMBODIMENT

Figure 1:
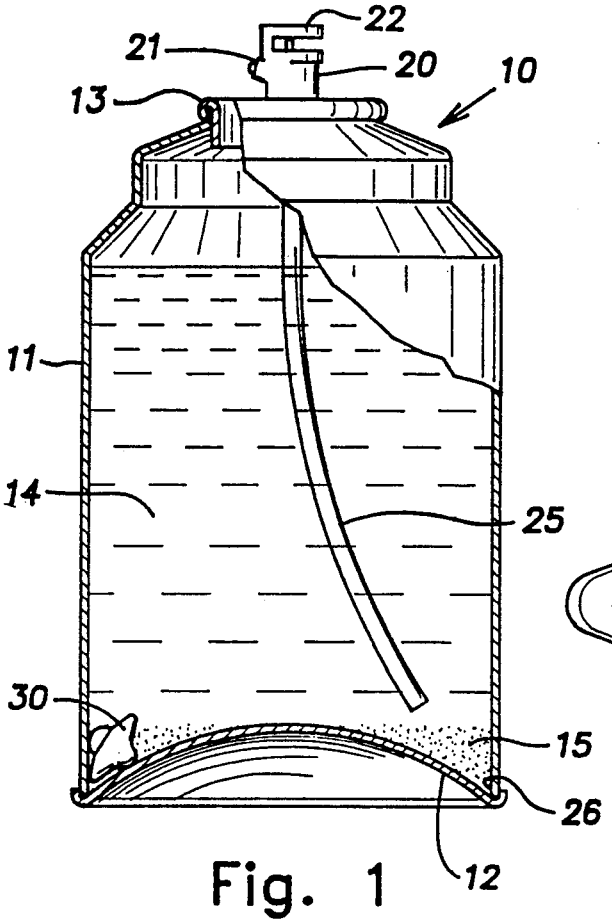
FIG. 1 shows a partial cut-away view of a spray can and agitator according to the present invention.

FIG. 1 shows a container, such as a can 10. The can normally has a generally cylindrical side wall 11. The side wall 11 is attached to a bottom wall 12 which is usually domed to withstand pressure inside the can. The can 10 is sealed by a top 13 which is secured to the side wall 11.

The can 10 holds contents 14 under pressure. Typically, the contents include solid particles, such as a pigment 15, a liquid vehicle and an at least partially liquified gaseous propellant. The liquid vehicle may include resins, oils, solvents and the like in which the pigment is suspended. The liquified gaseous propellant can be butane, propane, isobutane or others known in the art.

A valved nozzle 20 is provided to release the pressurized contents 14 of the can 10. Normally the nozzle 20 is mounted through a hole in the top 13, but can be mounted through the side or bottom walls. The nozzle 20 is usually a valve which is normally closed. An operator depresses a button 22 on the nozzle to open the valve and release the pressurized contents 14 of the can through an orifice 21 of the nozzle 20.

A tube 25 is connected to the nozzle 20 to carry the contents 14 to the nozzle 20. The tube 25 is preferably long enough to extend near the bottom of the can and may be curved somewhat to extend toward a corner 26 of the can 10 formed by the intersection of the side wall 11 and the bottom wall 12.

Figure 2:
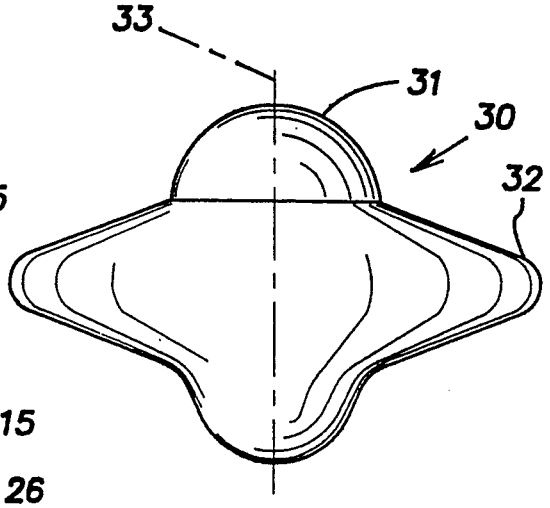
FIG. 2 shows one embodiment of an agitator formed according to the present invention.
Figure 4:
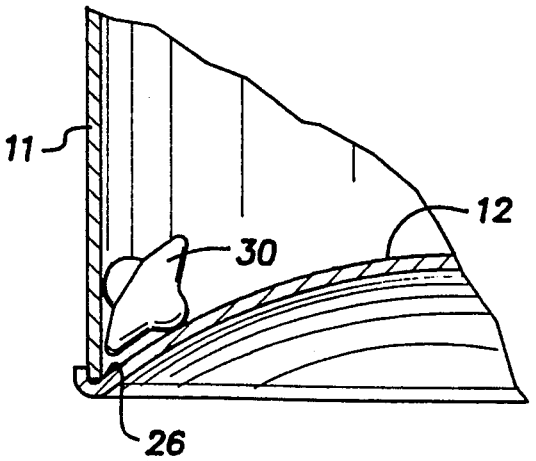
FIG. 4 shows a cut-away detail of a corner of the spray can and agitator.

An agitator 30 is located in the can 10. As shown in FIG. 2, the agitator 30 is a body with a generally rounded main portion 31 which could be a sphere such as a ball bearing. At least one projection extends from the main portion. In FIG. 2, this projection is shown as a radial flange 32 or rim around the main portion 31. This flange is preferably symmetrical about an axis 33 of the body. The flange should be shaped so that, when the agitator 30 rests near the corner 26 of the can, as shown in FIG. 4, the flange 32 extends into the corner 26 until it touches or nearly touches the corner 26 of the can.

The agitator should be of a material, such as low carbon steel, which is not corroded quickly by the contents 14 of the can. It should also be substantially more dense than the pigment 15 and other contents 14 and massive enough so that it can move through the contents 14 easily when the can 10 is shaken or otherwise agitated. A density of about 0.283 pounds per cubic inch has been used effectively. The size of the agitator 30 should be sufficient to agitate the contents 14 as it moves inside the can. The agitator 30 can be formed by known means such as forging including swaging, heading or impacting.

Figure 3:
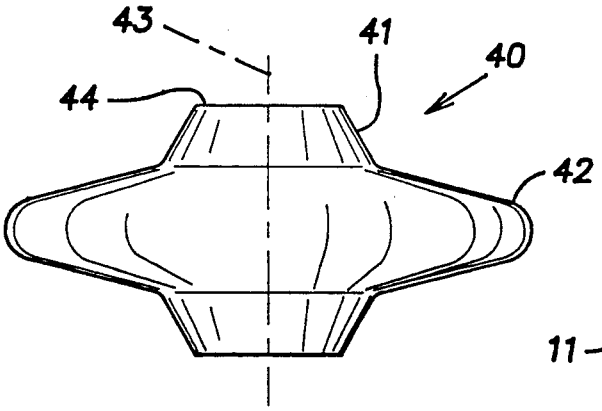
FIG. 3 shows another embodiment of an agitator formed according to the present invention.

FIG. 3 shows an alternative embodiment of an agitator 40 having a generally rounded main portion 41 which resembles frustrums of two cones having a common base and extending in opposite directions along an axis 43. The agitator 40 has a radial flange 42 similar to the flange 32 shown in FIG. 2. The flange could be described as frustrums of two cones having a common base coplanar with the common base of the main portion. The cones of the flange are shorter along the axis 43 and wider at the base than the cones of the main portion and have rounded corners.

Preferably, sharp edges are avoided and flat areas should be small compared to the total surface area of the agitator 40 to prevent the agitator from sticking in pigment 15 which builds up at the bottom of the can.

Although FIGS. 2 and 3 show two embodiments of the agitator 30 and 40, it is understood that the precise shape of the agitator is not limited to those shown, rather many shapes having rounded main portions with projections are comprehended by this disclosure.

Returning to FIG. 1, the pigment 15 tends to settle to the bottom of the can 10 during storage to form a gelatinous mass, while the rest of the contents 14 settle above the pigment. In order to efficiently spray the pigment onto the object to be colored, the pigment must be mixed with the liquid vehicle. Mixing is accomplished by shaking, swirling or otherwise agitating the can 10. Shaking causes some of the pigment 15 to mix with the other contents 14 and, more importantly, causes the agitator 30 to move through the contents 14 of the can thereby mixing the pigment 15 with the other contents 14. Particularly, the agitator 30 agitates the pigment at the bottom of the can and the novel shape of the agitator allows it to reach into the corner 26, as shown in FIG. 4, to agitate pigment 15 which would otherwise remain in the corner 26. The best mixing is achieved by a shape which rolls around the bottom in the corner, as shown in FIG. 4, when the can is swirled. The embodiment of FIG. 3 has been found to roll better than other shapes.

After shaking, the button 22 on the nozzle 20 is depressed to send a spray of the contents 14 including the pigment 15 onto an object to be colored or otherwise covered. As described above, the novel shape of the agitator provides more efficient mixing of the pigment compared to previously known agitators. Thus, less pigment is discarded with the can which reduces the total cost.

The present disclosure describes several embodiments of the invention, however, the invention is not limited to these embodiments. Other variations are contemplated to be within the spirit and scope of the invention and appended claims.

I claim:

1. An agitator for mixing solid particles with a liquid vehicle in a container when the container is shaken, comprising a body having a main portion having surfaces generally in the form of frustrums of two cones having a common base and extending in opposite directions with at least one projection extending therefrom.

2. An agitator according to claim 1, wherein the projection has a surface generally in the form of frustrums of two cones having a common base and extending in opposite directions, the base of the projection being coplanar with and larger than the common base of the main portion.

3. An agitator for mixing solid particles with a liquid vehicle in a container when the container is shaken, comprising a body having a main portion with a vertical axis and a generally circular cross-section when viewed along said vertical axis, said circular cross-section defining a circumference of the main portion; and a substantially continuous, annular, radially tapering flange projecting from the circumference of the main portion, the flange having a radial dimension at least as great as the radial dimension of the main portion along the vertical axis.

4. An agitator according to claim 3, wherein the main portion has a surface generally in the form of a spheroid.

5. An agitator according to claim 3, wherein the main portion has a surface generally in the form of an oblate spheroid.

6. An agitator according to claim 3, wherein the main portion has surfaces generally in the form of frustrums of two cones having a common base and extending in opposite directions.

7. An agitator according to claim 6, wherein the projection has a surface generally in the form of frustrums of two cones having a common base and extending in opposite directions, the base of the projection being coplanar with and larger than the common base of the main portion.

8. An agitator according to claim 3, wherein the main portion is rounded.

9. A container for holding a liquid vehicle, a liquified propellant gas and solid particles which tend to settle during storage, comprising:

at least one side wall secured to a bottom wall to form a corner; and an agitator in said container having a body having a main portion with a vertical axis and a generally circular cross-section when viewed along said vertical axis, said circular cross-section defining a circumference of the main portion; and a substantially continuous, annular, radially tapering flange projecting from the circumference of the main portion to move inside the container and mix solid particles from the corner of the container when the container is shaken or swirled.

10. A container according to claim 9, wherein the side wall is cylindrical and the bottom wall is domed inwardly.

11. A container according to claim 9, wherein the side wall is secured to a top wall.

12. A container according to claim 9, further comprising a nozzle for releasing the contents from the container.

13. A container according to claim 12, wherein the nozzle is a depressible button which directs a spray of the contents.

14. A container according to claim 12, further comprising a tube operatively connected to the nozzle for carrying the contents to the nozzle.

15. A container according to claim 9, wherein the container contains paint.

16. An agitator according to claim 8, wherein the main portion has surfaces generally in the form of frustrums of two cones having a common base and extending in opposite directions.

17. An agitator according to claim 9, wherein the main portion is rounded.

18. In a container for holding a liquid vehicle, a liquified propellant gas and a pigment which tends to settle during storage, having:

a cylindrical side wall secured to an inwardly domed bottom wall to form a corner; and a valved nozzle for releasing the contents from the container, the improvement which comprises:

an agitator in said container having a body having a main portion with a vertical axis and a generally circular cross-section when viewed along said vertical axis, said circular cross-section defining a circumference of the main portion; and a substantially continuous, annular, radially tapering flange projecting from the circumference of the main portion to move inside the container and mix solid particles from the corner of the container when the container is shaken or swirled.

19. An agitator according to claim 18, wherein the main portion has surfaces generally in the form of frustrums of two cones having a common base and extending in opposite directions.

20. An agitator according to claim 18, wherein the main portion is rounded.

* * * * *